United States Patent [19]

Buck

[11] Patent Number: 4,778,165

[45] Date of Patent: Oct. 18, 1988

[54] APPARATUS FOR FOLDING AND CUTTING WEB STACKS

[75] Inventor: Hermann Buck, Dettingen, Fed. Rep. of Germany

[73] Assignee: bielomatik Leuze GmbH & Co., Fed. Rep. of Germany

[21] Appl. No.: 43,226

[22] Filed: Apr. 27, 1987

[30] Foreign Application Priority Data

Apr. 30, 1986 [DE] Fed. Rep. of Germany ..... 3614683

[51] Int. Cl.[4] ..... B41L 1/32

[52] U.S. Cl. ..... 270/39; 493/362; 493/412; 271/188; 270/95

[58] Field of Search ..... 270/39–41, 270/47, 52, 152.5, 21.1, 95; 101/226–228; 225/1, 34, 97–98, 100–101, 103–106; 493/379–381, 418, 450, 386, 351, 340, 356, 398, 372, 357, 362, 390, 364, 366, 424, 429, 430, 433, 404–414, 353, 355, 345, 346; 271/188; 83/512

[56] References Cited

U.S. PATENT DOCUMENTS

| | | | |
|---|---|---|---|
| 843,781 | 2/1907 | Wheeler | 270/39 |
| 2,842,202 | 7/1958 | Boyd | 101/226 X |
| 3,406,959 | 10/1968 | Ross | 493/372 |
| 3,622,150 | 11/1971 | Hayes | 271/188 X |
| 3,858,476 | 1/1975 | Deligt | 83/512 |
| 4,396,336 | 8/1983 | Malamood | 270/95 |
| 4,406,650 | 9/1983 | Felix | 493/412 X |
| 4,460,350 | 7/1984 | Mittal et al. | 493/412 |
| 4,558,644 | 12/1985 | Bunch, Jr. | 101/226 |
| 4,650,447 | 3/1987 | Meschi | 493/412 |
| 4,673,382 | 6/1987 | Buck et al. | 493/359 |

FOREIGN PATENT DOCUMENTS

| | | | |
|---|---|---|---|
| 709804 | 6/1954 | United Kingdom | 493/355 |

*Primary Examiner*—Eugene H. Eickholt

*Attorney, Agent, or Firm*—Steele, Gould & Fried

[57] ABSTRACT

In the apparatus for binding stacks (31) of zig-zag-folded layers (40) a folder (10) is followed by a stacking device (43), which has a lifting table (14). In stacking area (41) following folder (10) is provided a separating device (24) in the form of a rake with front separating heads (100), which can be provided with blast air nozzles. A straightening device (22a) is used for periodically compressing the folded edge (82a) and the folder is preceded by a cutting mechanism (110) for making cuts on the folded edges (82a) to be separated, so that the separating devices (24) are not required to operate at areas on the edges provided with conveying holes.

15 Claims, 7 Drawing Sheets

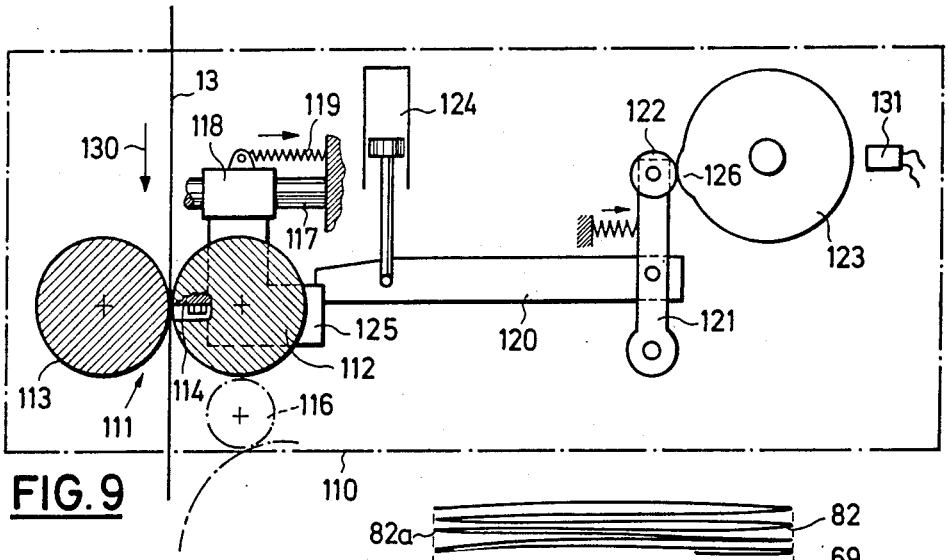
FIG. 9
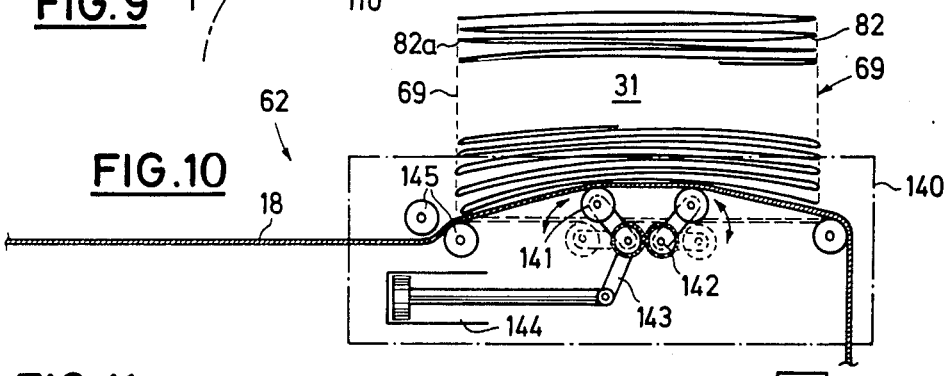
FIG. 10
FIG. 11
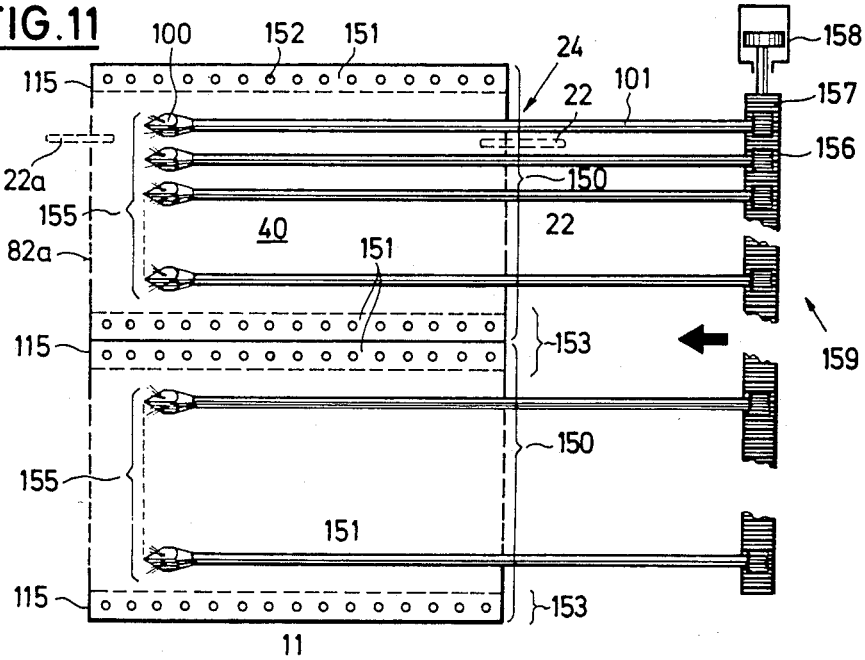

APPARATUS FOR FOLDING AND CUTTING WEB STACKS

BACKGROUND OF THE INVENTION

1. Field of the Invention

The invention relates to an apparatus.

2. Prior Art

German Pat. No. 267 958 discloses an apparatus in which horizontal separating devices are inserted into the start of the stack following the folder and which are constructed for carrying a partial stack and for separating through the folded paper web at a fold by means of a cutting edge on a separating and supporting device inserted horizontally into the stack. The separated stack discharge means has a conveyor belt on which the separated stacks are placed by plates functioning as a stacking table. U.S. Pat. No. 2,761,677 also describes such an apparatus.

German Pat. No. 30 13 865 describes an apparatus which carries out stack separation and conveying away in the same way. In the latter, throughout the separating process, the partial stacks are held above and below the separating device on their first or last sheets by special retaining devices, so as to prevent any displacement of the stack during separation and by a sloped raising of the upper stack part to form a large triangular gap for the insertion of separating devices. This requires the use of complicated machine parts, such as suction devices and the like.

According to the not previously published German patent application No. P 35 02 176, an exact formation of individual stacks and their conveying away, even at high running speeds, is made possible without retaining devices for the stack parts located above and below the separating device. The stacking table is provided with a displacement means and can be inserted by the latter in an upper position substantially horizontally, in the same direction as the separating device and synchronously into the stacking table, it being connected to the separating device and following on to the same substantially without any spacing during insertion. No retaining devices are necessary. The separating device is followed by the stacking table during its retraction and takes over the partial stack, without there being any danger of tilting or displacement of the stack. A small gap can be formed on the front stack edge by a separating element which can be swung into the stack from its upper edge, so that without difficulty the separating element can be inserted in the stack. It only opens the front stack edge and does not carry the stack over its remaining surface.

SUMMARY OF THE INVENTION

An object of the invention is to ensure reliable separation, even at high running speeds and with special material web types, e.g. punched or perforated papers, without there being any need for special retaining devices. This object is achieved in an apparatus of this type by providing at least one separating device for separating contiguous sheets through the stack, with means inserting the separating device into the stack at right angles to the stacking direction and then withdrawing the separation device again, the separating device during its insertion effecting separation along a folded edge between two layers, and including auxiliary means cooperating with the layers for assisting insertion or separation.

A main problem solved by the invention is that the layers in the stack acquire a curvature with increasing stack height, because the two folded edges take up more stack height than the actual layers. Thus, the stack is curved in such a way that the folded edges are higher than the centre, which can impede the insertion of the separating devices and completely satisfactory separation, as well as conveying away. The individual embodiments of the invention solve the set problem, but are advantageously used jointly and/or in combination.

The upstream cutting mechanism, located in the material running direction upstream of the folder, which partly cuts through the layers at the folded edge where subsequent complete separation will be effected by the separating device in transverse regions provided with perforations, ensures that it is possible to deal with particularly difficult separation problems in the region of special portions of the material web, e.g. in the vicinity of perforated or punched edges of the layers. Layers having a fixed or separable hole edge or rim for processing on automatic printers of data processing equipment are especially frequently worked on folding devices, which eject counted folded layers and which are normally called "stock form collators". Apart from these so-called Remaliner hole systems, other constructions are particularly critical during separation, e.g. transverse regions of the material web provided with detaching holes and the like, because the separating devices can become caught in the hole edges, particular if the layers are curved in the separating region. Even in the case of unpunched, longitudinally perforated edges, the longitudinal perforations can lead to problems on tearing open the transverse perforation. The prior cutting in or through said regions ensures that on the one hand there is adequate cohesion and on the other that in said critical regions the separating devices do not have to come into action or do not have to carry out any separating work there. Thus, e.g. in the case of punched layers where there is a particular risk of catching, the area in which the separating devices have to function can be limited to the uncut regions. The arrangement just upstream of the separating point and appropriately just upstream of the folder ensures that the cuts do not lead to difficulties during the remaining working of the material web. As working often takes place in juxtaposed manner in several similar web strips, the cuts can be made centrally within the material web and not only in the region of the outer edge.

The auxiliary device according to the invention, constructed as a straightening device ensures through an arching of the stack from below, that the resulting stack curvature is displaced into the lower stack region and consequently keeps the surface of the stack substantially planar in the separating plane.

The straightening devices included in the invention, force together the stack edges formed by the superimposed folds, so as to better "break" the fold and to keep the curvature of the stack as limited as possible. The straightening devices are preferably operated many times during stack formation, a swinging device ensuring that they pass in frictionless manner into the stack. Thus, e.g. in the case of a stack with 250 layers, the straightening devices can come into action every 50 layers.

The construction with a rotary drive for the separating bars also aids improved insertion and separation. The bars can be made very flat, so that they can easily be inserted, whilst still having a considerable separating action as a result of rotation, rotation preferably taking place in the vicinity of the folded edge to be separated.

Particular preference is given to a separating device construction, in which it comprises parallel bars in the insertion direction having separating heads constructed in spear tip-like manner and which ensure that the perforation at the fold is broken open and not cut open, which prevents any risk of stack displacement and cutting into the web. Separation is further improved in that air blast or blowing air is discharged through the separating bars.

Features of preferred further developments of the invention can be gathered from the subclaims, description and drawings, the individual features being realizable individually or in the form of subcombinations in any embodiment of the invention.

BRIEF DESCRIPTION OF THE DRAWINGS

An embodiment of the invention is described hereinafter relative to the drawings, wherein show:

FIG. 9 A diagrammatic representation of the cutting mechanism only shown as a block in FIGS. 1 to 5.

FIG. 10 Diagrammatic representation of the bulging or arching device previously indicated as a block.

FIG. 11 A plan view of the stack, as well as the separating and straightening devices in the separating plane.

DETAILED DESCRIPTION OF THE PREFERRED EMBODIMENTS

Figure 1:
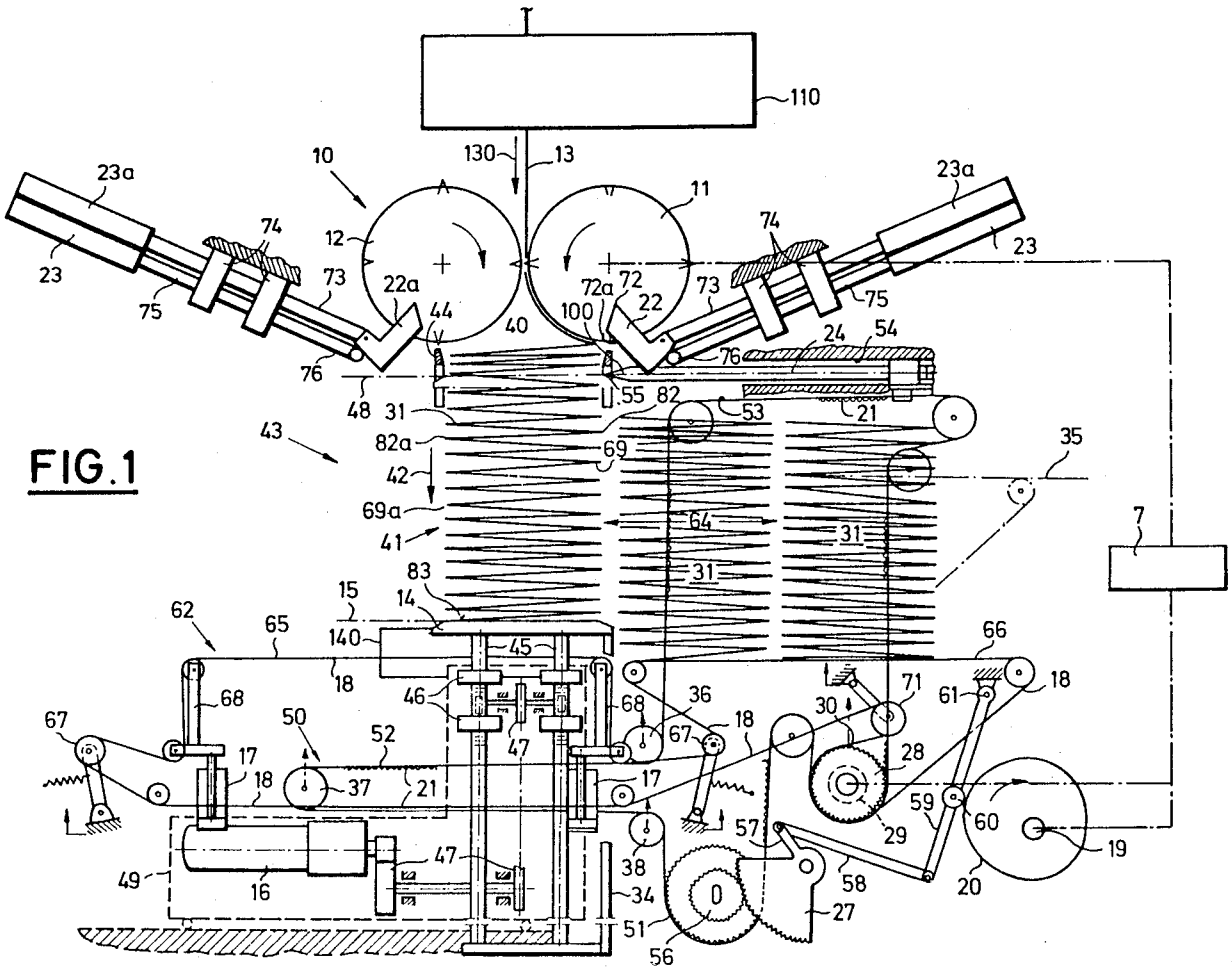
FIGS. 1 to 5 Diagrammatical side views of the apparatus in five different working positions and in certain cases only the components necessary for explaining the particular working step are shown so as not to overburden the drawing.

The apparatus shown in FIGS. 1 to 5 is normally the end section of an apparatus for producing folded layers from a material web 13, particularly a paper web. In the machine part (not shown) upstream of folder 10 perforations and punched openings and the like are made in the material webs 13 which are printed once, but juxtaposed in several format widths.

The material web which passes vertically from above into the folder 10 in the represented embodiment is provided with folds by two folding rollers 11, 12 having a predetermined spacing, following passing through a subsequently described cutting mechanism 110 and then placed in the form of zig-zag layers 40 in a stack 31. The stack forms in a stacking region 41, also called a stacking shaft and is guided in the stacking direction 42, i.e. vertically downwards in the present case.

The folder can be a per se known jaw folder, such as is known e.g. from German Pat. No. 178 663, incorporated herein by reference. They are driven by a variable speed or change-over gear 7 synchronously with a shaft 19, which controls a large proportion of the functions of the complete stacking device 43.

On the upper part of the stacking region 41 adjacent to folder 10 are provided on the leading and trailing edges guide members 44, which guide between them stack 31 in said upper region and are constructed in the manner of combs or rakes. In the working position according to FIG. 1 stack 31 rests on a lowerable stacking table 14, which is carried by pillars 45, which are vertically displaceably guided in guides 46 and e.g. via racks on the pillars can be raised and lowered by a motor 16 by means of a toothed wheel and chain gear 47 and namely from lower position 15 into the dot-dash line indicated upper position in separating plane 48.

Motor 16, gear 47 and guides 46 and therefore the complete stacking table 14 are located on a horizontally displaceable slide 49, indicated in broken line form. It is horizontally displaceable between the right-hand position shown in FIGS. 1, 2 and 5 and the left-hand position shown in FIGS. 3 and 4, namely through being coupled to a toothed belt 21, which belongs to a displacement means 50. Toothed belt 21 is guided in endless manner about numerous guide pulleys, e.g. 36, 37, 38, a driving gear 51 and a driving disk 28. Apart from the horizontal strand 52 driving slide 49, there is also a horizontal strand 53, which can horizontally reciprocate a separating device 24 running in a horizontal guide 54.

Separating device 24 comprises several rake or comb-like, horizontally juxtaposed bars, e.g. round bars, which are provided on the front side with a tip 55 and which can pass through the comb-like guide elements 44 adapted thereto. Separating device 24 can be reciprocated between the position shown in FIG. 1, where it is located outside stacking region 42 and the position according to FIG. 3, in which tips 55 project through the left-hand guide element 44.

Displacement means 50 is driven by means of a toothed gear 56 connected in non-rotary manner to driving gear 51, a toothed segment 27 engaging therewith, a crank 57 fitted thereto, a connecting rod 58 and a one-arm lever 59, which is connected in articulated manner to a swivel bearing 61 and carries a driving roll 60, which follows a cam 20 on shaft 19. Segment 27 is reciprocated by cam 20 via linkage 57 to 61 and thereby rotates driving gear 51 backwards and forwards in oscillating manner, so that slide 51 coupled thereto and the separating device 24 are horizontally reciprocated by the same amount in the same direction. The toothed belt drive could be replaced by some other displacement means, e.g. with levers directly from a cam or a pneumatic drive. However, the two toothed belts running upstream and downstream of the stacking regions in the drawing provides a relatively adaptable displacement means, which simultaneously also drives belt conveyor 18 forming a discharge means 62 for stack 31. The discharge means contains an arching device 140 to be described in greater detail hereinafter relative to FIG. 10.

Toothed belt 21 runs round the driving disk 28, which is oscillated backwards and forwards by it and is connected by means of a freewheel means 29 to a driving gear 30 for belt conveyor 18, so that the driving gear is always only driven clockwise, so that belt 18 is only conveyed stepwise in the direction of arrow 63 in each case by amount 64, i.e. the spacing between two stacks on the discharge line.

Figure 2:
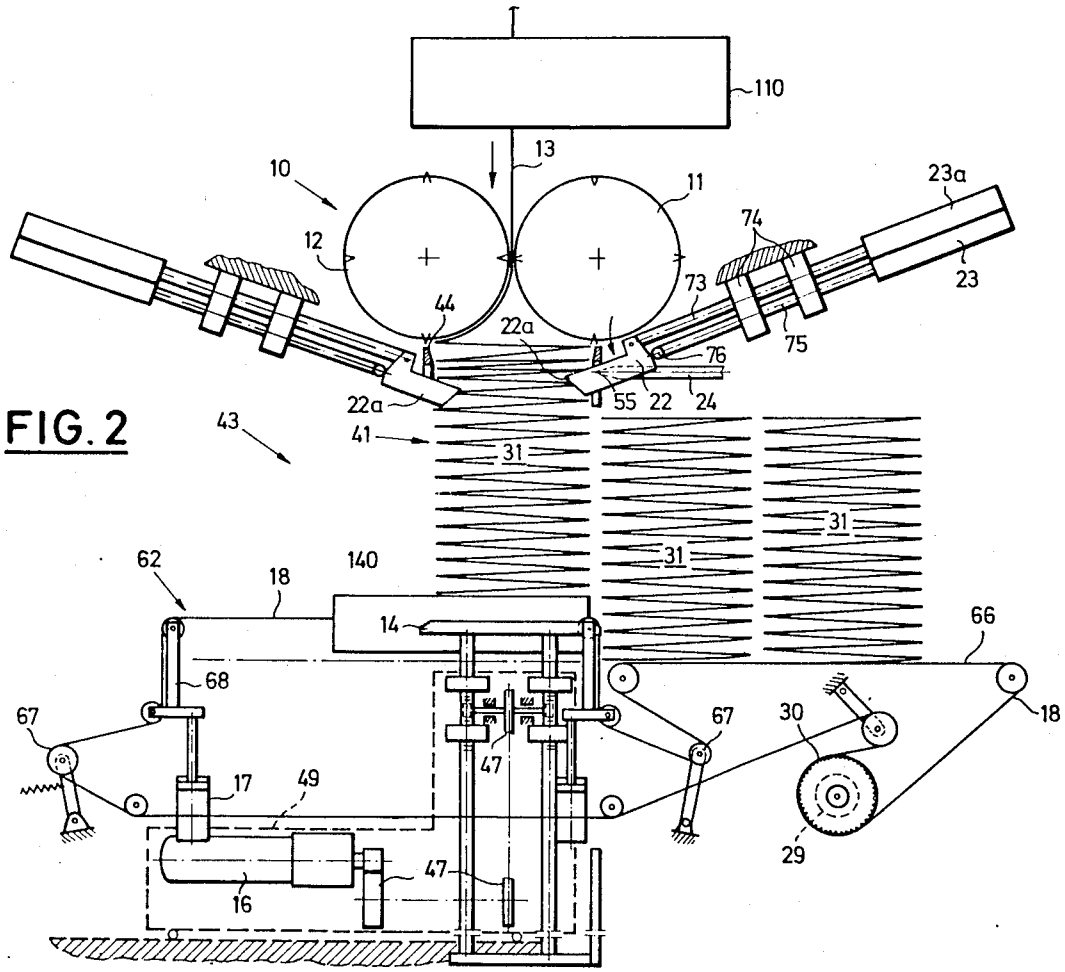
Figure 3:
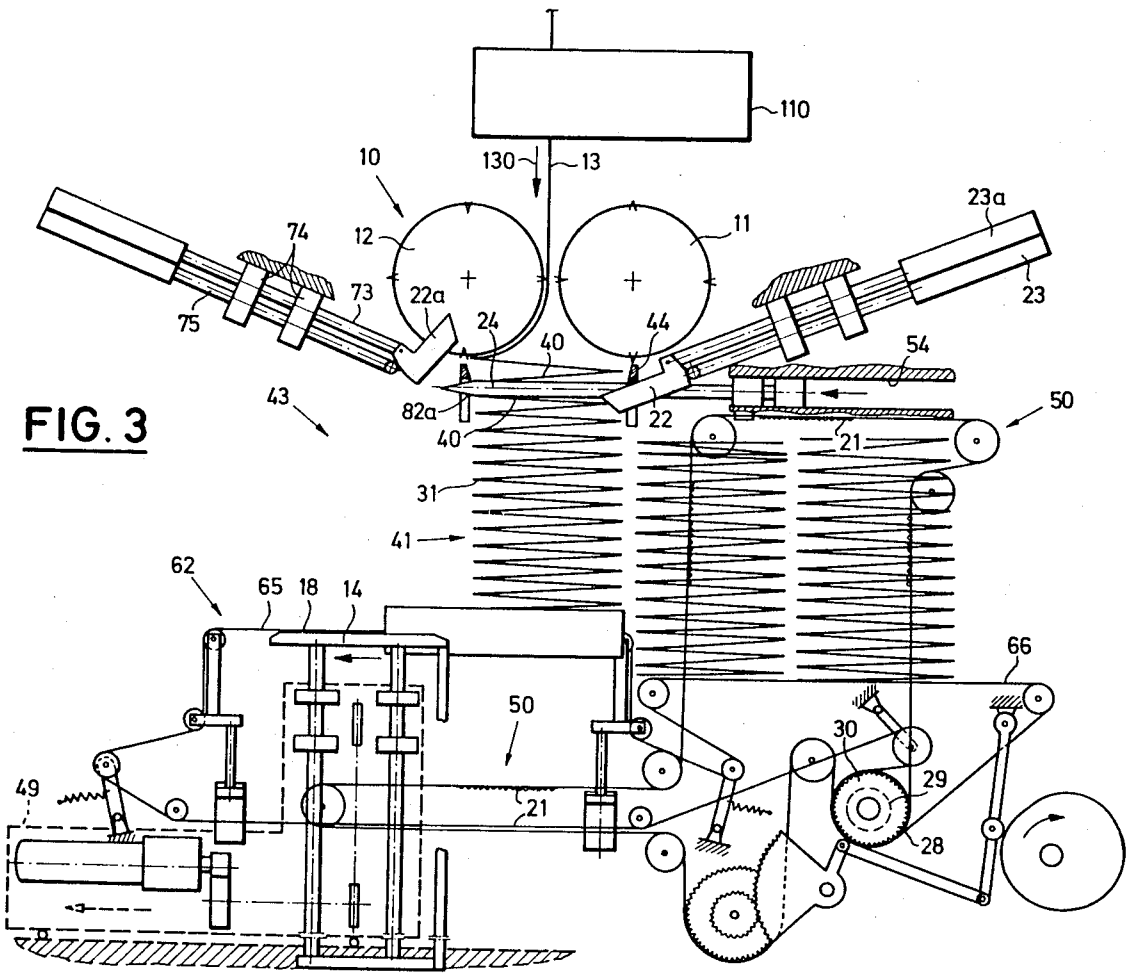

Belt conveyor 18 is guided round numerous guide pulleys in such a way that it forms two horizontal belt sections 65, 66, whereof that running in the vicinity of the stacking table can be raised independently of belt section 66. At the start and finish of belt section 65, the belt is guided in Z-shaped manner by means of a pair of guide pulleys fitted to a lifting element 68 and is subsequently provided with compensating sections, which are kept under tension by spring-loaded guide pulleys 67. The lifting elements 68 can be simultaneously raised by pneumatic cylinders 17 and consequently raise belt section 65 with the arching device 140 over the plane of the lower position 15 of stacking table 14 (c.f. FIGS. 2 and 3). In the lowered position shown in FIG. 1 belt sections 65, 66 are at the same level. Belt conveyor 18 comprises spaced belts, so that through the plane thereof can run the stacking table which also comprises individual, spaced strips. At least one ledge-shaped support is connected at the bottom to stacking table 14 and on it can be supported the left-hand (in the drawing) stacking of a stack to be conveyed away during its discharge from the stacking region and on passing between belt sections 65, 66. At the lower end a yoke connects the support together with the columns 45.

A broken line in FIG. 1 indicates that for manual setting purposes the complete belt 18 with its guide pulleys, lifting mechanisms 17, 68 and driving gear 30, as well as the stacking table and slide 49 can be raised into an upper position 35, if reduced height stacks are to be produced. Displacement device 50 with its guide pulleys 36, 37, 38, toothed belt 21 and driving disk 28 are also raised, but driving gear 51 remains fixed. Thus, the drive of displacement device 50 and the discharge means 62 indirectly driven by it is not impaired by the height adjustment.

On the upper edge of stack 31 and over separating device 24 are guided straightening members 22, 22*a*, which comprise in each case one ratchet-like lever with a tip or cutting edge 72 and a pressure surface 72*a*. It is connected in articulated manner to one end of a rod 73, which is guided in sliding guide 74 over separating element 24 inclined by an angle between approximately 10° and 30° relative to the horizontal. Parallel and below the same is guided a further rod 75, which acts with a roll 76 at its end on the straightening member 22 and can consequently pivot the latter between an upwardly sloping position (FIG. 1) and a downwardly sloping position directed towards the stack (roughly in the extension of rods 73, 75, as in FIGS. 2 and 3). Each of the rods 73, 75 is connected to the piston of a pneumatic cylinder 23, 23*a*.

On the left-hand side in the drawings, i.e. in the vicinity of the folded edge 82 to be separated, is provided a member 22*a*, whose construction and action is like that described hereinbefore. The drive of said left-hand straightening member 22*a* also takes place by means of pneumatic cylinders 23, 23*a*.

Straightening members 22, 22*a* are arranged in such a way that they are normally in the vicinity of the stack edges 69, 69*a* above the stack, i.e. in the vicinity of folding rollers 11, 12, so that they can engage from above in the stack before the latter is formed. The straightening members enter the stack without any risk of collision with the layers and swing through the separating plane 48, whilst pressing on the folded edges 82, 82*a* on stack edges 69, 69*a* and so compress the fold there that it is no higher than the layer thickness. In the downwardly swung position thereof, straightening members 22 are located in a gap of the separating device with the tips thereof in front of the retracted tips of the separating device 24, so that they divide the stack for the insertion of the separating device.

Figure 6:
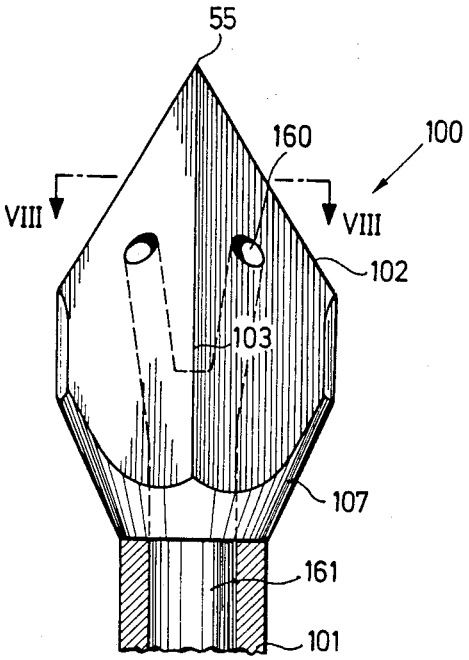
FIG. 6 A plan view.
Figure 7:
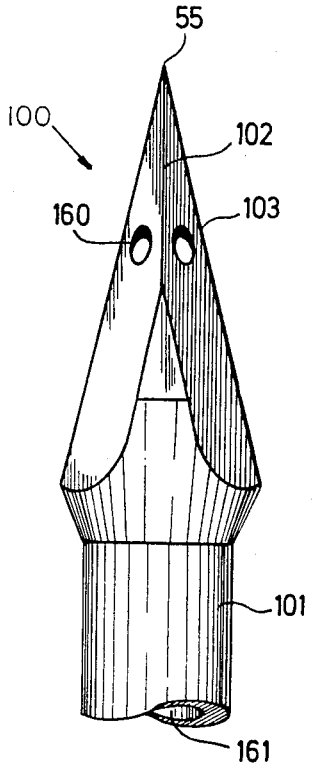
FIG. 7 A side view of a separating head.
Figure 8:
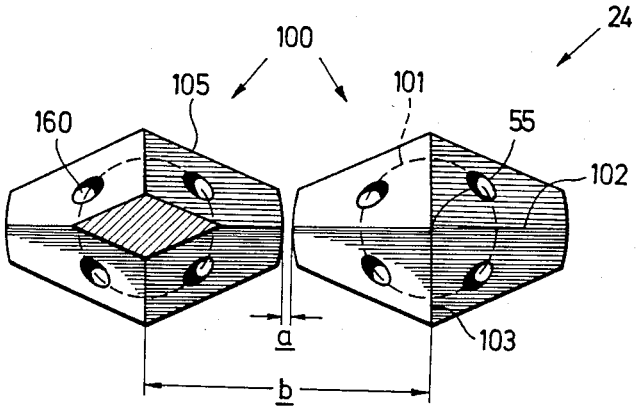
FIG. 8 A front view of two separating heads.

Separating head 100 shown in FIGS. 6 to 8 forms the front end of each bar 101 of separating device 24. The bars 101 are horizontal and parallel to one another in the insertion direction of the separating device 24. The separating head 100 is shaped like a spear tip with a rhombic cross-section, whose edges 102, 103 converge in the front tip 55. The separating head is wider and thicker than the associated bar 101, so that there is a very small spacing a between in each case two separating heads 100 in the horizontal direction and this only represents a fraction of the total width of the separating head or the distance t between the bars (preferably 5 to 10%). However, this spacing can be made larger if straightening members 22*a* are to engage there. The greatest width of the rhombic cross-section of separating head 100 is in the horizontal direction and the edges 102 pointing in this direction form between them an angle between 45° and 9O°, preferably approximately 6O°. However, the angle formed by the upwardly and downwardly pointing edges 103 is only roughly half as large and is between 25° and 4O°, preferably 3O°. The rhombic tip passes in the vicinity of edges 102 into a cylindrical cross-section and then into a conical cross-section 107, which reduces the total width of the separating head to the dimensions of bar 101. Edges 102, 103 are not sharply ground and are instead deburred.

This leads to a flat, wedge-shaped blade, which does not cut the web at the perforated folding edges and instead is only intended to break them open. Along the fold, the web is curved upwards and downwards in wavy form and the bridges holding together the web parts are broken open in planned manner. The horizontal and vertical force components produced by the separating head and not the cutting capacity of the edges are important for this purpose. Thus, they need not be as marked as in the represented embodiment. In particular there is no need for edge 103, so that the tip could have a lenticular cross-section. Thus, the described separating head successively tears open the perforation bridges, without tearing the web and namely without exerting great transverse forces on the stack. The juxtaposed separating heads 100 engage in recesses of strip 44 at the end of their path. The corrugated surfaces on the top and bottom of separating device 24 formed by the joined together separating faces 105 and clearly visible in FIG. 8 are so far apart in the end position of the separating stroke that with the small spacing a bridge located in the gap would certainly be torn open.

Additionally the separating heads 100 can be provided with blast air openings 160. There can be four blast air openings per separating head and namely one in each of the four surfaces defining said head. They are located in the insertion direction and are directed slightly apart and connected to a central air duct 161, provided in the separating head and in separating bars 101. It is also possible to provide the blast openings 160 on only one and preferably the lower side of the separating head and supply blast air to assist separation during the separation process.

FIG. 9 shows the cutting mechanism 110 located directly upstream of folder 10 in the path of material web 13. It contains a crosscutter 111 with a knife spindle 112 and a counterknife spindle 113 against which function the cutting knives 114 secured in knife spindle 112. They comprise individual portions or sections, which are so arranged along the knife spindle 112 that cuts 115 only occur in specific cross regions (c.f. FIG. 11). Crosscutter 111 is driven by the drive of folding drums 11, 12 via an idler gear 116.

A knife spindle support 125 carrying the knife spindle 112 is horizontally displaceably mounted on a linear guide 117 by means of a ball box 118 and is so loaded by a spring 119, that normally the knife spindle 112 is removed from the counterknife spindle forming the counter cutting face and the material web 13 passes through unaffected by the crosscutter.

The knife spindle 112 is brought by a pawl 120 into cutting engagement and is driven in longitudinal oscillating manner by a pivotable lever 121 via a runner 122 and a cam disk 123. Normally the pawl is drawn upwards by a pneumatic cylinder 124 and is consequently disengaged from the knife spindle support 125, so that pawl 12O idles backwards and forwards. Only on operating pneumatic cylinder 124, is the pawl engaged on the knife spindle support 125 in the manner shown in FIG. 9 and is consequently ready. If cam 126 of cam disk 123 displaces the pawl 120 to the left in the drawing via runner 122 and lever 121, the knife spindle 112 is pressed against the counterknife spindle 113 and the partial cutting process is initiated.

Cam disk 123 is synchronized with the drive of folder 10, but can be geared down in such a way that it e.g. performs one revolution for every ten layers. As the cam 126 takes up a maximum of one tenth of the circumference of cam disk 123, cutting can still take place at a precisely defined point, which is such that it takes place directly in the folded edge 82*a*, which will subsequently also be separated by separating device 24.

FIG. 10 shows the arching or bulging device 140, which forms part of the discharge means 62 and serves to impart an upwardly directed curvature to the belt conveyor 18 in the vicinity of stack 31, whilst the separating device 124 is inserted in the top of the stack. Arching device 14O has two freewheeling support rolls 141 for belt conveyor 18, which can be pivoted on lever arms between a downwardly swung position represented in broken line form and an active, upper position shown in continuous line form. For this purpose the lever arms are coupled together by means of toothed gears 142, one of which can be pivoted by a pneumatic cylinder 144 via a lever 143. A guide pulley pair 145 engaging on the belt conveyor from both sides supports the belt section 65 of belt conveyor 18 in the area in which it carries the stack.

FIG. 11 is a plan view of layer 40 and separating device 24 in separating plane 48. Layers 40 formed by the material web 13 are such that two forms 150 can be folded and stacked in juxtaposed manner. They have on either side a separable edge or border 151, in which are made conveying perforations 152 in the material web longitudinal direction. Cuts 115 are also made in this area. Thus, they extend over the cross regions 153 formed by the Remaliner edge, provided in each case on the edge and (in double width) in the centre of the layer and can advantageously be much wider than shown, e.g. approximately 50% wider than the edge width 153. Cuts 115 could also be made at other points. The limit with regards to the number and width of the cuts is that of ensuring that the material web 13 passes perfectly through the folder. An arrangement of the cutting mechanism directly upstream of the separating device or folder is important, because in the preceding working stations the cohesion of the layers should be better.

The individual separating bars 101 forming the separating device and whose longitudinal guide has been omitted for simplification purposes in the drawing are arranged in groups and take up an area indicated by bracket 155. This area is located between edges 151, so that the separating bars 101 are not present in the vicinity of edge 151, even when the edges are in the centre of the layer.

The separating bars 101 are provided with a rotary drive 159 and for this purpose carry on their ends remote from separating heads 100 pinions 156, which engage in a rack 157, which is reciprocated by a pneumatic cylinder 158.

The described apparatus operates according to the following method. FIG. 1 shows a working stage, in which the formation of a high stack 31 on stacking table 14 is almost ended. Stacking table 14 has reached its lower position 15, whilst separating device 24 and straightening members 22, 22*a* are outside stack region 41.

As shown in FIG. 2, by operating pneumatic cylinder 23, rod 73 is now moved towards the stack, so that the straightening member is swung into stack region 41 and namely over the top layer being formed on the folder. It swings into a position in which the tip 72 is upstream of the separating device tip 55. Thus, the straightening members run into the stack during the formation of the latter and consequently do not have to divide the layers. Swinging in lasts until some layers have been placed on the straightening members, so that on compressing the folded edges 82, 82*a* they do not impede the newly formed layers. The straightening members 22, 22*a* are ledge or strip-like and arranged in each case between two separating bars 101 and have a height such that their lower pressure surfaces 72*a* can considerably compress the folded edges.

During stack formation, the straightening members are swung in, e.g. every 50 layers, so that in the case of a stack of 200 layers there is four times a straightening through compressing to relatively far below the separating plane 48. Thus, the layers in stack 31 remain relatively flat. Whereas the left-hand straightening members 22*a* are extended again prior to the separating process, the right-hand straightening members 22 remain in the stack and form a gap into which the separating devices can be introduced.

For stack change purposes, the belt section 65 of belt conveyor 18 of discharge means 62 is passed through the plane of stacking table 14 above the same, so that it takes over stack 31. This takes place by operating pneumatic cylinder 17 using the compensating section formed by the spring-loaded guide pulley 67.

Immediately thereafter cam 20 operates the toothed segment 27 via lever mechanism 57 to 61 and consequently the driving gear 51 of toothed belt 21 in such a way that the resulting displacement means 50 draws horizontally to the left simultaneously slide 49 and therefore stacking table 14 with its lifting mechanism and separating device 24 in guide 54. The stacking table is now to the left alongside the stack region 41 and separating device 24 passes into stack 31, runs between two layers 40 and separates said layers in the vicinity of the rear folded edge 82*a* where the layers are only interconnected by a perforated line (FIG. 3). Tips 55 and edges 102 of separating heads 100 cooperate with the guide member, which forms a type of steady bracket or counter-edge. Different separating through types can be used as a function of the nature of the guide members or separating device and they are largely dependent on the desired separation quality and the nature of the fold (extent of perforations). However, it has been found that separation by means of the individual tips or edges permits an adequately reliable and clean separation for the practical applications which occur. During the movement of the toothed belt 21 between the position of FIGS. 2 and 3 the freewheel means came into operation, so that there was no movement of belt conveyor 18.

During separation and optionally also during insertion, compressed air was blown out through the blast air openings 16O, so that a compressed air cushion formed between adjacent layers and the separating process was improved and optionally completely satisfactory insertion of the separating bars is possible, even with sensitive papers. Rotary drive 159 for the separating bars 101 serves to provide a better separation, even when there is a somewhat larger spacing of the separating heads 100 than that shown in FIG. 8. When the bars are in their working position rack 157 is reciprocated once by operating pneumatic cylinder 158, so that the separating bars complete a rotation and namely preferably by approximately 9O° backwards and forwards. Thus, the flat rhombic separating heads 100 are turned from their flat alignment normally in separating plane 48, so that they assume a much greater height and therefore reliably break open the perforation on separating fold 82*a*, without exerting any significant transverse force on the stack.

In the vicinity of edges 151 there are no separating bars, because they only occur in areas 155 (FIG. 11) positioned in the vicinity of the unpunched layer surface, i.e. outside the edges. The breaking open of the separating fold is not required in areas 153, because the said fold 82*a* is already separated there by cuts 115.

These were previously made by the cutting mechanism 110 and, controlled by a contactless sensor 131, a signal for operating pneumatic cylinder 124 was given in such a way that the cuts 115 are imparted to that separating fold intended for stack separation under the further guidance by straightening members 22 and separating device 24. An advantage of the invention is that folding and stacking from cutting mechanism 110 to the separating point takes place in sheet-precise manner, because the straightening member 22 takes over the layers directly on leaving folder 10, i.e. there is no chance separation in a given stack height.

For crosscutting purposes the pawl normally pressed under spring tension on cam disk 123 and running thereon with runner 122 is brought into the position according to FIG. 9, the runner not being raised from the cam. During the next passage of cam 126 the knife spindle 112 is advanced against the counterknife spindle 113 and makes the cuts 115. Immediately after the cut runner 122 leaves cam 126, pawl 12O is retracted and the knife spindle support 125 is again drawn by spring 119 back into the inactive position of the crosscutter. In place of the described crosscutter with a counterknife spindle, it would also be possible to use other cutting means, e.g. a crosscutter with a fixed counterknife, either the knife spindle or the counterknife being advanced for periodically making cuts. Other cutting means are also usable, e.g. those having a linearly moved knife.

It is ensured that the cuts 115 are only made on the folded edge which is subsequently to be separated, i.e. between the last sheet of the previous stack and the first sheet of the following stack.

Prior to the insertion of separating device 24, i.e. In the working stages between FIGS. 2 and 3, the pneumatic cylinder 144 of arching device 140 was operated and pivoted the belt idlers 141 out of their lower position, in which they kept flat the belt 18 running above the same, into the swung up position shown in FIG. 10, so that they now impart an upward curvature to the belt. Thus, in the lower region of the stack it acquires an upwardly curved shape, which acts counter to the concave shape otherwise assumed in the upper part of the stack and which results from the fact that the folded edges 82, 82*a* are somewhat higher than the actual layers. This also contributes to a flat stack in separating plane 48, which facilitates the insertion of the separating device, even in the case of difficult papers. After the insertion of the separating device, it is possible to eliminate the arching of belt section 65 by corresponding operation of pneumatic cylinder 144 and the lowering of belt idlers 141.

Figure 4:
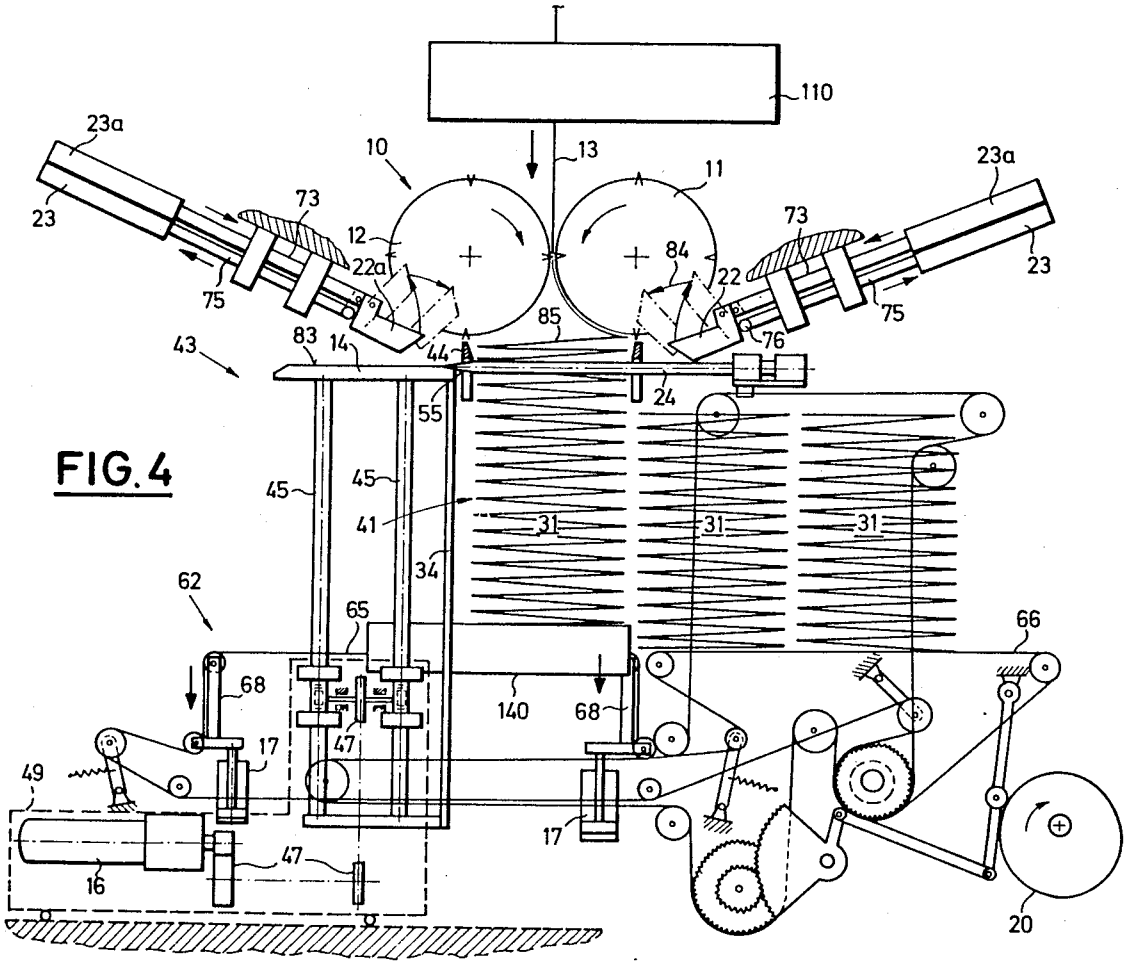

FIG. 4 shows that through the retraction of the piston into pneumatic cylinder 17, lifting element 78 can be lowered again, so that belt section 65 is once again level with belt section 76 and stack 31 is correspondingly lowered. Simultaneously, through the operation of motor 16 via gear 47, stacking table 14 is raised through the belt plane into position 48, where its stacking surface 83 is roughly aligned with the upper edge of the separating devices 24. Stacking table 14 thereby moves upwards alongside stack region 41.

Through the simultaneous retraction of both rods 73, 75 in FIG. 4, by operating pneumatic cylinders 23, 23*a*, straightening member 22 is retracted from the stack region. The pivoting and advance movement indicated by the bent arrow 84 in FIG. 4 is thereby performed, in which firstly with rod 73 retracted, straightening member 22 is swung upwards through the advance of rod 75 and then through simultaneous movement of rods 73, 75 towards the stack, straightening member 22 in its upwardly directed position is moved into the waiting position according to FIGS. 1 and 5, so that it is once again ready for use.

Since the insertion of separating device 24 (FIGS. 3 and 4), a new partial stack 85 has formed on the separating device and which consequently during this time carries partial stack 85. Thus, although the separating device is relatively close to the folder, it is at such a distance therefrom that a certain partial stack formed up to the end of the stack change process can be formed and housed between separating device 24 and folder 10.

Figure 5:
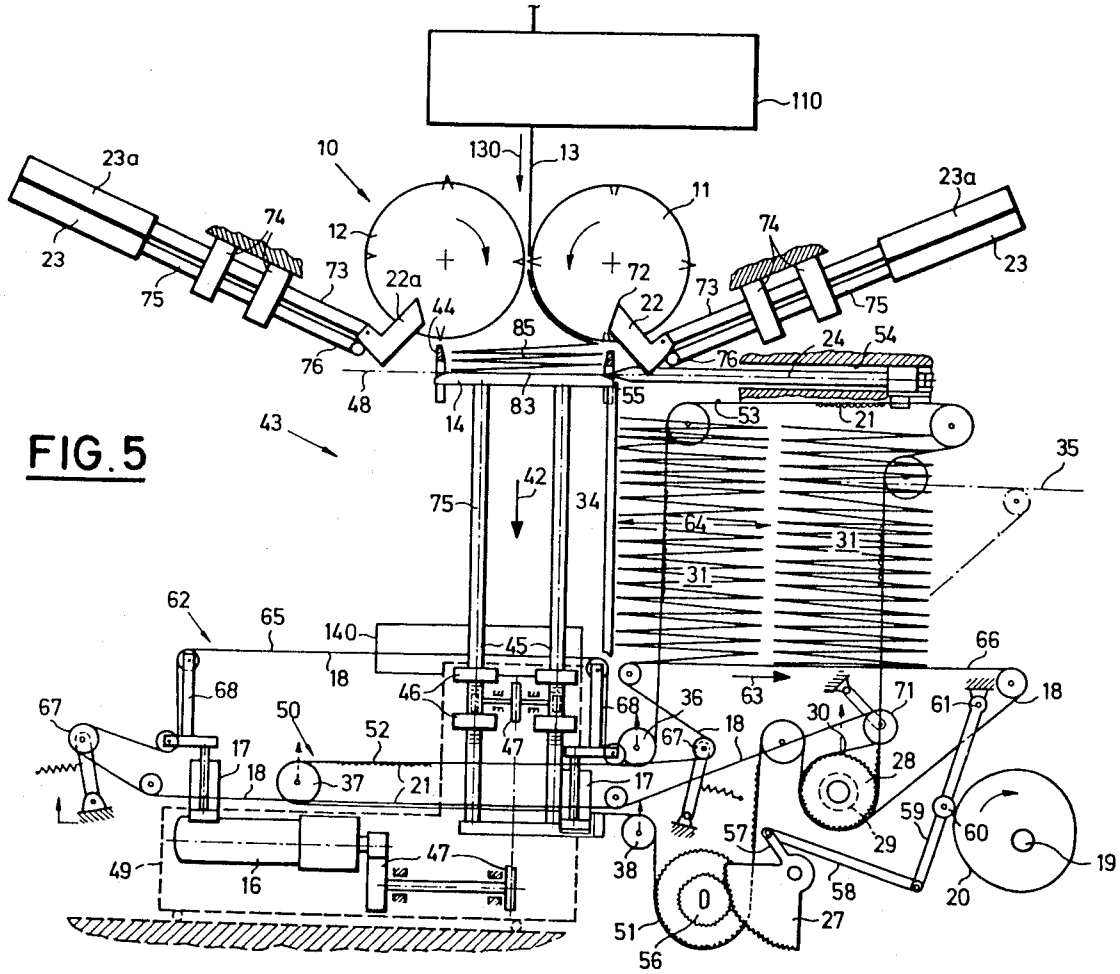

Under the action of the further rotating cam 20, FIG. 5 shows that by means of the connecting mechanism segment 27 is swung to the other side, so that driving gear 51 so moves the toothed belt 21 of displacement means 50 that separating device 24 and stacking table 14 are moved to the right of the drawing in a horizontal, synchronous and unidirectional manner, so that separating device 24 is moved out of stack region 41 and stacking table 14 is moved into said region. Stacking table 14 and separating device 24 abut with one another without any gap and in fact somewhat overlap, in that the tips 54 of the separating device rest on a lateral slope of the stacking table. This reciprocal position was already assumed in FIG. 4 and is maintained during the transfer to the right. The partial stack 85 formed on separating device 24 is moved by the right-hand guide elements 44 on to stacking table 14, which now again assumes its function as a lowerable stack support. In accordance with the formation of the stack, stacking table 14 is lowered by motor 16 in direction 42 (FIG. 1).

FIG. 5 shows that simultaneously with the movement of toothed belt 21, driving disk 28 is rotated and by means of freewheel device 29 drove the driving gear 30 for belt conveyor 18 in said direction and therefore moved belt 18 by amount 64, in the vicinity of belt sections 65, 66, which are in this case at the same level, to the right, i.e. under separating device 24 and between the toothed gears 21. The stack is supported by support ledges 34, whilst running over the gap between the two belt sections 65, 66. Thus, there is a stepwise conveying away of the formed stack 31 on belt section 66, from which it can be conveyed on or removed.

Belt conveyor 18 can be replaced by some other discharge means, e.g. a device operating with sliders or gripper fingers, which move the stack on a table or roller tracks. Although the raising of the belt section 65 is advantageous and following the subsequent lowering of said section there is an adequate free space over the stack to permit the removal thereof below the separating device, it would also be possible by corresponding further lowering of the stacking table to carry out the transfer at a constant belt section height.

The indirect drive of the belt conveyor 18 via the toothed belts by means of a freewheeling means ensures a reliable synchronization of movement. However, it would also be possible to provide for the belt conveyor a drive directly derived from the synchronous shaft 19. Shaft 19 is so connected to the drive of folder rollers 11, 12, that in the case of a given minimum number of layers 40, it performs a revolution, e.g. for 100 or 200 sheets. If stacks with a larger or smaller number of layers dividable by this minimum number are required, then the synchronous shaft 19 is disengaged for a few revolutions. During this time the stack is formed (in the position between FIG. 5 and FIG. 1 following it in the cycle). However, it is also possible by coupling to another point to form a different number of layers, which are not dividable by the said minimum number or to enable the layer count to be performed by means other than by the folder. Motor 16 and pneumatic cylinders 17, 23 are controlled by a control means in the described operating sequence, which can e.g. also be operated by means of cams or the like on synchronous shaft 19. In particular the speed of motor 16 must be regulatable in accordance with the stack "growth rate".

The individual auxillary means 110, 140, 160 etc. are used as a function of the nature and quality of the materials to be processed, the design and prior preparation thereof, as well as the necessary running speed. They have the common aim of ensuring satisfactory stack separation without fixing the layers above and below the separating point. However, they can have a different construction to that shown in the drawings. Thus, e.g. the arching of the stack in the lower region can be brought about by shaped parts acting from below, an upwardly curvable base during sliding transfer, etc.

I claim:

1. An apparatus for folding material webs such as paper webs and for placing said webs in a stack of folded layers, with a folder and a stacking means, in which the stack is formed in a stack region and in a stacking direction, the apparatus comprising:

separating means for separating contiguous folded layers in the stack, the separating means being arranged adjacent to the folder;

a separating means drive, operative to insert the separating means into the stack in a direction transverse to the stacking direction and to withdraw the separating means from the stack, and during insertion of the separating means to effect separation along a folding edge between said two contiguous layers;

a pre-cutting mechanism located upstream of the folder in a running direction of the material, the pre-cutting mechanism partly cutting through the contiguous layers at the folding edge to be subsequently completely separated by the separating means; and, the pre-cutting mechanism and the separating means being synchronized, such that said pre-cutting mechanism and said separating means respectively cut and separate the same folded edge, which folded edge is preceded and followed by a predetermined number of folded edges which are not cut.

2. The apparatus according to claim 1, wherein the pre-cutting mechanism is operative to cut the material webs at regions thereof provided with perforations.

3. The apparatus according to claim 2, wherein the pre-cutting mechanism is a rotary cross cutter controlled and driven as a function of operation of the folder and the separating means, the pre-cutting mechanism having knives arranged at predetermined zones across a width of the material webs.

4. The apparatus according to claim 2, wherein the separating means is disposed only at regions across a width of the material webs between regions cut through by the pre-cutting mechanism.

5. An apparatus for folding material webs such as paper webs and for placing said webs in a stack of folded layers, with a folder and a stacking means, in which the stack is formed in a stack region and in a stacking direction, the apparatus comprising:

separating means for separating contiguous folded layers in the stack, the separating means being arranged adjacent to the folder;

a separating means drive, operative to insert the separating means into the stack in a direction transverse to the stacking direction and to withdraw the separating means from the stack, and during insertion of the separating means to effect separation along a folding edge between said two contiguous layers;

straightening means operative for aligning a surface of the layers of the stack in the stack region, the straightening means acting on already-formed layers in the stack, the straightening means including arching means movably operative to raise an area of said layers of the already-formed stack between folding edges thereof, said arching means comprising a belt conveyor means periodically operable for discharging the stack, the belt conveyor means having belts guided on guide rollers, and means for lifting certain of the guide rollers for bending the belts into an arcuate path.

6. An apparatus for folding material webs such as paper webs and for placing said paper webs in a stack of folded layers, with a folder and a stacking means, in which the stack is formed in a stack region in a stacking direction, the apparatus comprising:

separating means for separating contiguous folded layers in the stack, the separating means being arranged adjacent to the folder;

a separating means drive, operative to insert the separating means into the stack in a direction transverse to the stacking direction, and to withdraw the separating means from the stack, and during insertion of the separating means to effect separation along a folding edge between the contiguous layers;

straightening means operative for aligning a surface of the layers of the stack in the stack region, the straightening means acting on already-formed layers of the stack, the straightening means having a straightening member located on an edge of the stack containing the folding edge to be separated, said straightening member periodically compressing the stack at said stack edge, and means for operating the straightening member after a predetermined number of folding edges are folded and at predetermined intervals during subsequent operations of the separating means.

7. The apparatus according to claim 6, comprising a first straightening member arranged on the stack edge containing the folding edge to be separated, the first straightening member being kept out of engagement with the stack during separation of the layers by the separating means, and a second straightening member arranged on an other edge of the stack, the second straightening member being introduced into the stack in the vicinity of a separating plane, during insertion of the separating device.

8. An apparatus for folding material webs such as paper webs and for placing said webs in a stack of folded layers, with a folder and a stacking means, in which the stack is formed in a stack region in a stacking direction, the apparatus comprising:

separating means for separating contiguous folded layers in the stack, the separating means being arranged adjacent to the folder and having a plurality of rake-like juxtaposed separating bars with front separating edges;

a separating means drive, operable to insert the separating means into the stack in a direction transverse to the stacking direction and to withdraw the separating means therefrom, and during insertion of the separating means in the stack to effect separation along a folding edge between two layers in the stack; and, a rotary drive operable to rotate the separating bars about respective longitudinal axes of the separating bars, backwards and forwards in the oscillating manner.

9. The apparatus according to claim 9, wherein separating edges are provided on a separating head on each separating bar, the separating head having a flattened shape.

10. The apparatus of claim 9, wherein the separating head has a spear tip-like shape.

11. The apparatus of claim 9, wherein the separating head tapers forwardly to a tip and has a rhombic cross-section with four separating edges, an angle formed between said separating edges located in a separating plane being between about 45° and about 90°, and an angle formed between the separating edges directed at right angles to said separating plane being between about 25° and about 45°.

12. The apparatus according to claim 9, wherein the separating head on the separating bars project beyond a circumference of the separating bars, a relatively small space being provided between adjacent ones of the separating heads.

13. An apparatus for folding material webs such as paper webs and for placing said webs in a stack of folded layers, with a folder and a stacking means, in which the stack is formed in a stack region in a stacking direction, the apparatus comprising:

separating means for separating contiguous folded layers in the stack, the separating means being arranged adjacent to the folder and having separating edges;

a separating means drive, operable to insert the separating means into the stack in a direction transverse to the stacking direction and to withdraw the separating means therefrom, and during insertion of the separating means in a stack to effect separation along a folding edge between two layers in the stack, and blast air outlets being provided on the separating means.

14. The apparatus according to claim 13, wherein the blast air outlets are arranged in surface areas of the separating means adjacent to the separating edges.

15. The apparatus according to claim 13, wherein the blast air outlets are arranged on an underside of the separating means in a separating region thereof and a blast air supply to said blast air outlets is switched on during separation.

* * * * *

UNITED STATES PATENT AND TRADEMARK OFFICE

CERTIFICATE OF CORRECTION

PATENT NO. : 4,778,165

DATED : October 18, 1988

INVENTOR(S) : Hermann Buck

It is certified that error appears in the above-identified patent and that said Letters Patent is hereby corrected as shown below:

Column 1, lines 62-63 delete "separation" and insert --separating--.

Column 8, line 53 after "82a" insert a comma.

Column 9, line 60 delete "In" and insert --in--.

Column 13, line 42, delete "9", second occurrence, and insert --8--.

Signed and Sealed this

Twenty-fourth Day of October, 1989

*Attest:*

DONALD J. QUIGG

*Attesting Officer*

*Commissioner of Patents and Trademarks*